US011008687B2

(12) United States Patent
Tseng

(10) Patent No.: US 11,008,687 B2
(45) **Date of Patent: *May 18, 2021**

(54) POSITIONING DEVICE FOR AN ALLY MOVABLE TONGUE SEAT

(71) Applicant: Hsien-Chang Tseng, Taichung (TW)

(72) Inventor: Hsien-Chang Tseng, Taichung (TW)

( * ) Notice: Subject to any disclaimer, the term of this patent is extended or adjusted under 35 U.S.C. 154(b) by 118 days.

This patent is subject to a terminal disclaimer.

(21) Appl. No.: 16/392,651

(22) Filed: Apr. 24, 2019

(65) Prior Publication Data

US 2020/0340158 A1 Oct. 29, 2020

(51) Int. Cl.
*D05B 37/08* (2006.01)

(52) U.S. Cl.
CPC ..... *D05B 37/08* (2013.01)

(58) Field of Classification Search
CPC ..... D05B 37/08; D05B 37/04; D05B 37/00; D05B 1/20
USPC ..... 112/122, 318, 464, 270
See application file for complete search history.

(56) References Cited

U.S. PATENT DOCUMENTS 2,133,812 A * 10/1938 Gellman ..... D05B 37/04 411/368
3,167,042 A * 1/1965 Bono ..... D05B 37/04 112/122.1
4,570,558 A * 2/1986 Hirayama ..... D05B 1/20 112/162
5,154,129 A * 10/1992 Schips ..... D05B 1/20 112/197
5,216,970 A * 6/1993 Sakuma ..... D05B 1/20 112/168
5,503,094 A * 4/1996 Tseng ..... D05B 73/12 112/165
5,529,003 A * 6/1996 Kojima ..... D05B 37/04 112/168
6,109,195 A * 8/2000 Inagaki ..... D05B 1/20 112/130
7,367,274 B2 * 5/2008 Sadasue ..... D05B 1/20 112/122
10,801,142 B2 * 10/2020 Tseng ..... D05B 27/16

FOREIGN PATENT DOCUMENTS

JP 2005000401 * 1/2005 ..... D05B 1/20
TW I363822 * 5/2012 ..... D05B 1/20

* cited by examiner

*Primary Examiner* — Alissa L Hoey
*Assistant Examiner* — Patrick J. Lynch
(74) *Attorney, Agent, or Firm* — Bruce Stone LLP; Joseph A. Bruce

(57) ABSTRACT

A positioning device for rotating a movable tongue seat is essentially provided with a pin and a pin hole between a movable tongue seat and a cutter seat for driving the movable tongue seat. Rotating the positioning member can drive the movable tongue seat to move to a corresponding position, so that the movable tongue on the movable tongue seat can be extended and retracted from the top of the seat in an optimal position, and can be reliably controlled.

18 Claims, 9 Drawing Sheets

POSITIONING DEVICE FOR AN ALLY MOVABLE TONGUE SEAT

BACKGROUND

Field of the Invention

The present invention relates to a positioning device for a sewing machine, and more particularly to a positioning device for rotating a movable tongue seat of a sewing machine.

Related Prior Art

A movable tongue seat of a cutter seat of a sewing machine is usually provided with a movable tongue, which is disclosed in Taiwan Patent No. I363822. Between the movable tongue seat and the movable tongue is provided an adjustment device in the form of a linear slide member, according to the disclosure of the Taiwan Patent No. I363822, when an adjustment rod of the adjustment device rotates, an eccentric cam disposed on the movable tongue (the linear slide member) will rotate, which consequently causes the rotation of a linkage, and the linkage will move approximately along the Y-axis direction due to the fact that the linkage has one end coupled to an eccentric area of the eccentric cam. At another end of the linkage, a swing cam of the movable tongue is pivotally disposed in an elongated slot and driven to rotate by a pin disposed in an above cavity, so that the swing cam can rotate about the shaft parallel to the X axis. The rotation of the swing cam of the movable tongue can cause the lateral displacement of the coupling protrusion formed around the annular surface of the swing cam along the X-axis direction, and another end of the movable tongue seat opposite to the end (of the movable tongue seat) fixed by the pin will swing approximately in the X-axis direction. The movement of the movable tongue seat requires two parallel cams and an eccentric to drive a linkage, the structure as a whole is complicated and involves motion conversion in multiple-axis directions, which can only be achieved by very high accuracy. After a period time of use, the parts of the whole structure might wear off and affect the fitting accuracy between the parts of the structure, and as a result, the movable tongue seat is unable to move the movable tongue to the desired position, and amendments are therefore necessary.

Taiwan Patent No. 1363822 mentions a Japan Patent No. 2005-401, wherein the adjustment device for adjusting the position of the movable tongue includes the use of a micro-adjustment rod to rotate an eccentric cam and cause lateral displacement of a linkage. The pivot portion of the linkage is also caused to move laterally to cause movement of the end of the movable tongue, which consequently causes deviation of the movable tongue seat. However, the movement of the movable tongue lacks solid guidance. Besides, the movable tongue seat and the cutter seat interfere with each other. This structure is also complicated, and after a period time of use, the parts of the whole structure might wear off and affect the fitting accuracy between the parts of the structure, and as a result, the movable tongue seat is unable to move the movable tongue to the desired position, and amendments are therefore necessary.

The present invention has arisen to mitigate and/or obviate the afore-described disadvantages.

SUMMARY

One objective of the present invention is to provide a low cost and high driving efficiency positioning device for rotating a movable tongue seat, wherein a stable adjustment can be achieved by a simple structural arrangement.

To achieve the above objective, the positioning device for rotating the movable tongue seat in accordance with the present invention comprises:

a positioning member disposed between the movable tongue seat and the cutter seat, the positioning member being provided with a rotary end which is located toward one end of the cutter seat, wherein the positioning member rotates about the rotary end and is further provided with a drive member having a plurality of teeth for engaging with teeth of a driven portion of the movable tongue seat, so that the drive member drives the driven portion, the drive member and the rotary end are coaxially arranged; and a pivot hole and a pivot provided between the movable tongue seat and the cutter seat, so that the movable tongue seat is able to rotate on the cutter seat by rotating about the pivot, when the positioning member rotates about the rotary end, the drive member can push the movable tongue seat to rotate about the pivot to a desired position.

The positioning device of the movable tongue seat in accordance with another embodiment of the present invention comprises:

a positioning member disposed between the movable tongue seat and the cutter seat, the positioning member being provided with a rotary end which is located toward one end of the cutter seat, wherein the positioning member rotates about the rotary end and is further provided with a drive member which is in contact with and drives a driven portion of the movable tongue seat, the drive member and the rotary end are coaxially arranged; and a pivot hole and a pivot provided between the movable tongue seat and the cutter seat, so that the movable tongue seat is able to rotate on the cutter seat by rotating about the pivot, when the positioning member rotates about the rotary end, the drive member pushes the movable tongue seat to rotate about the pivot to a desired position.

It is learned from the above that the driven portion and the drive member can all be rotated about the rotary end of the positioning member no matter by means of contact friction or gear engagement, and then the drive member drives the movable tongue seat to rotate about the pin to a desired position, thereby achieving a reliable and stable adjustment result, and the function of low cost, reliable driving and high-efficiency operation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

The present invention will be clearer from the following description when viewed together with the accompanying drawings, which show, for purpose of illustrations only, the preferred embodiment in accordance with the present invention.

Figure 1:
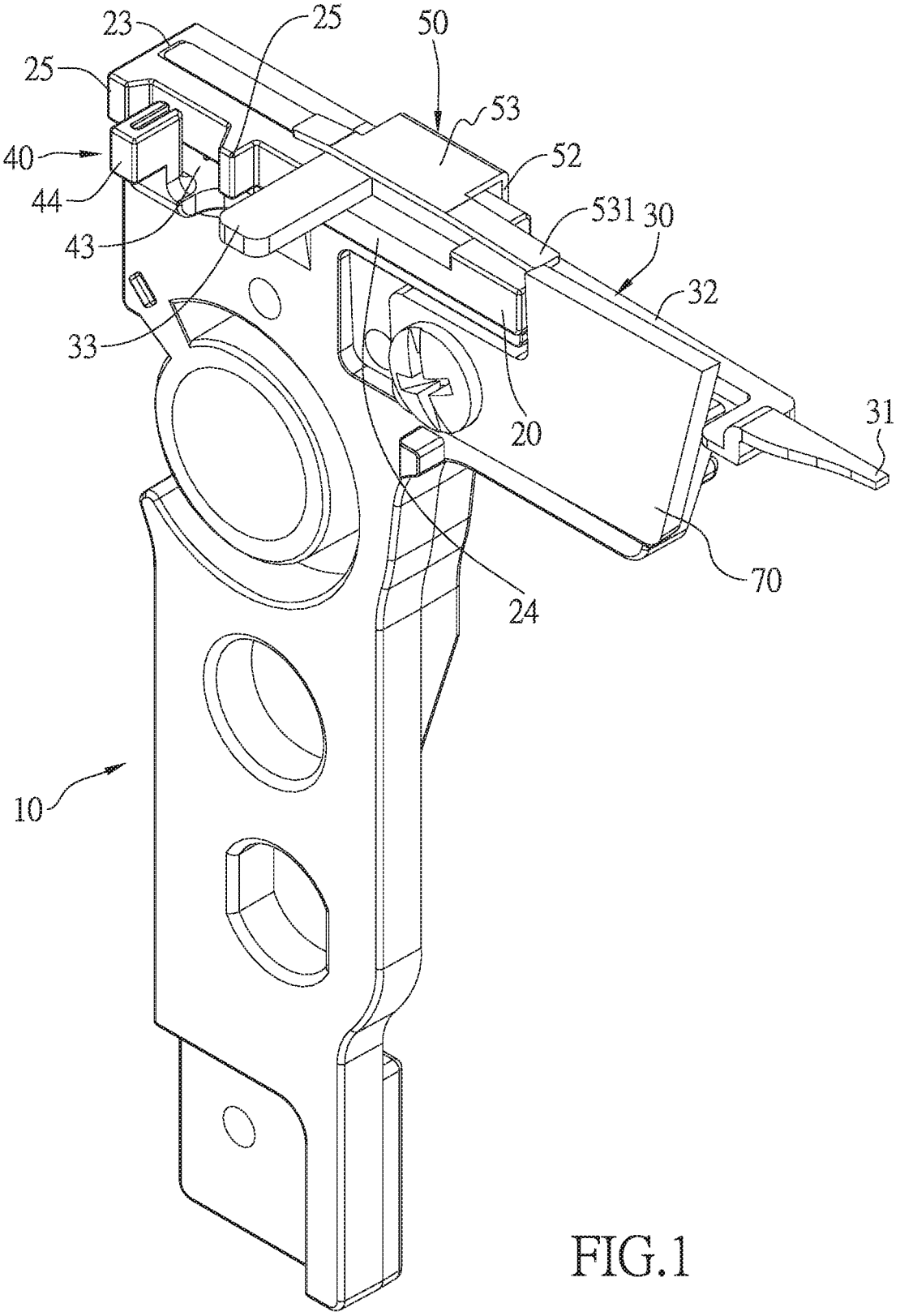
FIG. 1 is an assembly view of the positioning device for rotating the movable tongue seat in accordance with a first embodiment of the present invention.
Figure 2:
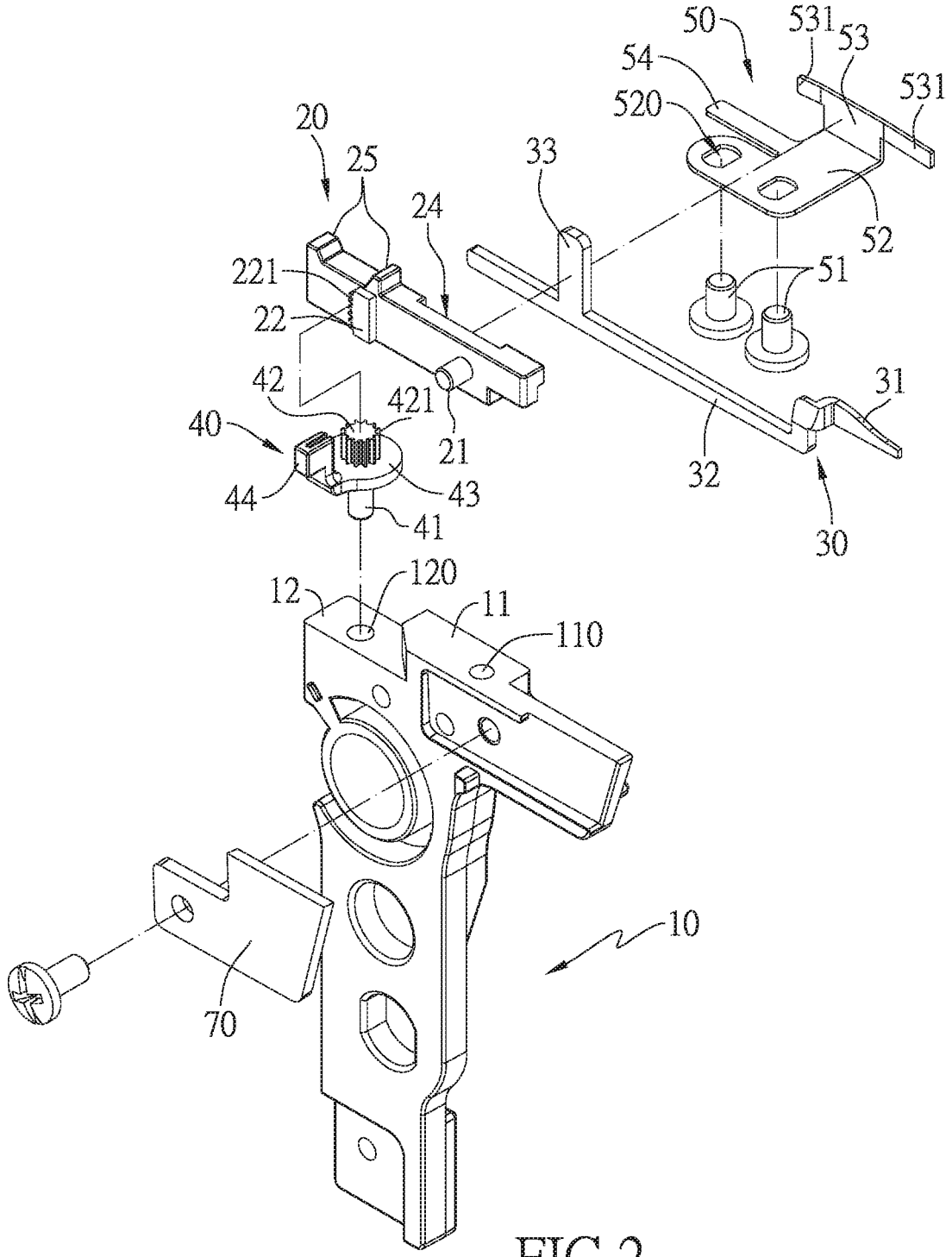
FIG. 2 is an exploded view of the positioning device for rotating the movable tongue seat in accordance with the first embodiment of the present invention.
Figure 3:
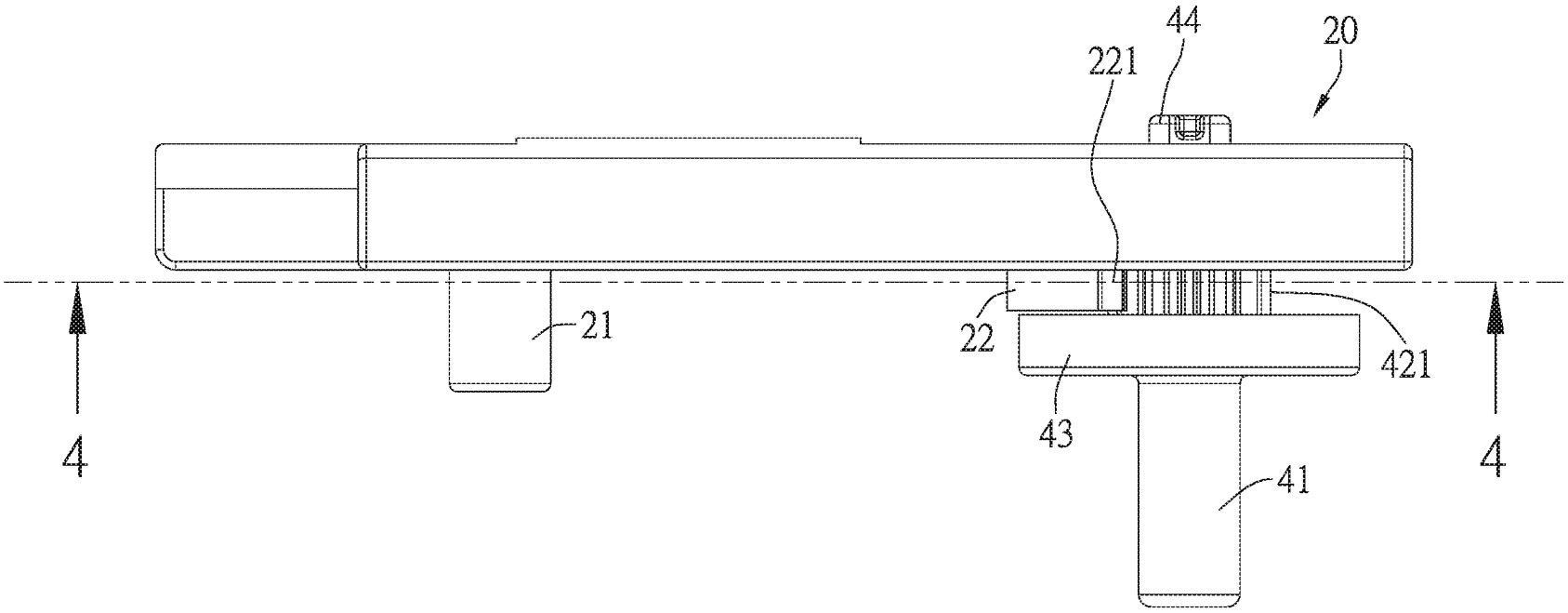
FIG. 3 is a side view of the positioning device for rotating the movable tongue seat in accordance with the first embodiment of the present invention.
Figure 4:
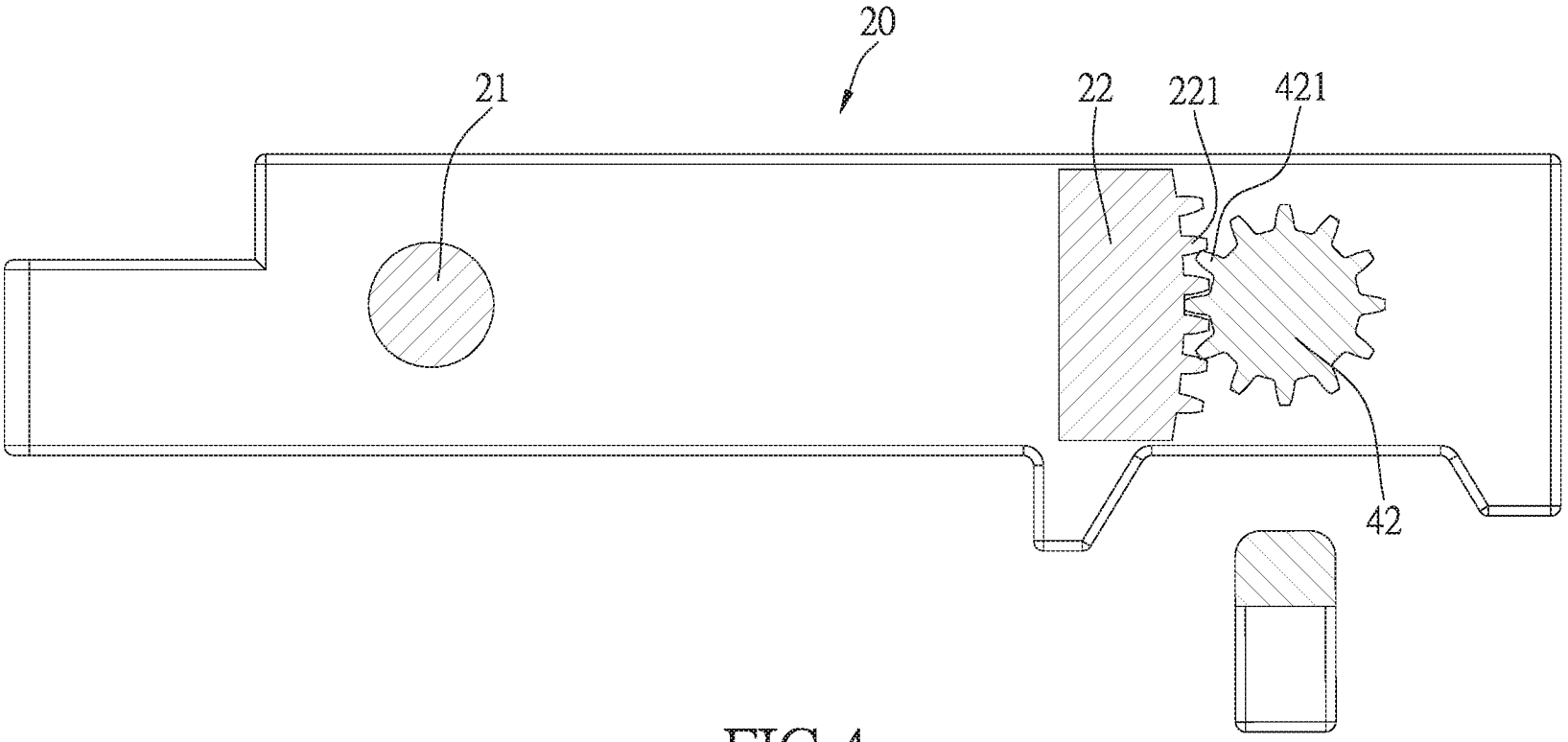
FIG. 4 is a cross sectional view of the positioning device for rotating the movable tongue seat in accordance with the first embodiment of the present invention.

Referring to FIGS. 1-3, the positioning device for rotating a movable tongue seat 20 in accordance with a first embodiment of the present invention is shown, wherein the movable tongue seat 20 is provided on a cutter seat 10 of a sewing machine, and on the movable tongue seat 20 is provided a movable tongue 30 which includes a tongue end 31, a guide portion 32 extending from the tongue end 31, and a pulling end 33 perpendicular to the guide portion 32. The movable tongue seat 20 includes a guide member 23 in the form of a groove, and a gap 24 formed in a lateral surface of the guide member 23, so that the guide portion 32 is slidably received in the guide member 23, and the pulling end 33 extends out of the gap 24.

The positioning device for rotating the movable tongue seat 20 comprises a positioning member 40 which is disposed between the movable tongue seat 20 and the cutter seat 10. The positioning member 40 is provided with a cylinder-shaped rotary end 41 which is located toward one end of the cutter seat 10. The positioning member 40 rotates about the rotary end 41 and is further provided with a columnar drive member 42 which is in contact with and drives a driven portion 22 of the movable tongue seat 20. The drive member 42 and the rotary end 41 are coaxially arranged, so that, when the positioning member 40 rotates, the drive member 42 will rotate simultaneously to surely cause displacement of the movable tongue seat 20 by contacting the driven portion 22. The positioning member 40 is further provided with a disc-shaped damping portion 43 which is located between the drive member 42 and the rotary end 41 to facilitate the fixing of the angle of the positioning member 40 (the angle at which the positioning member 40 is located), and the rotary end 41 is located at the center of the disc-shaped damping portion 43. A pulling portion 44 extends from the edge of the damping portion 43.

A pivot hole 110 and a pivot 21 are provided between the movable tongue seat 20 and the cutter seat 10, so that the movable tongue seat 20 can rotate on the cutter seat 10 by rotating about the pivot 21 which is inserted in the pivot hole 110. When the positioning member 40 rotates about the rotary end 41, the drive member 42 can push the movable tongue seat 20 to rotate about the pivot 21 to a desired position. The movable tongue seat 20 is provided at a lateral edge thereof with two protrusive restricting portions 25 which cooperate with the pulling portion 44 to restrict the rotation angle of the positioning member 40.

It can be learned from the drawings that a top surface of the cutter seat 10 includes a first end surface 11 and a second end surface 12 which is lower than the first end surface 11. The pivot hole 110 is located at the first end surface 11 for insertion of the pivot 21 which protrudes out of a bottom of the movable tongue seat 20. A blade 70 is provided at a lateral surface of the first end surface 11 of the cutter seat 10, and a pressing member 50 is provided at another opposite lateral surface of the first end surface 11 of the cutter seat 10. An adjustment hole 120 is provided at the second end surface 12, and the rotary end 41 is disposed in the adjustment hole 120 of the second end surface 12 of the cutter seat 10.

The pressing member 50 is fixed on the cutter seat 10, and in this embodiment shown in the drawings, the pressing member 50 is located at another lateral surface of the first end surface 11 opposite to the blade 70 and fixed to the cutter seat 10 by two bolts 51 inserting through a vertical end of the pressing member 50. The pressing member 50 is a flat piece which is bent into an L-shaped elastic structure. The vertical end of the pressing member 50 is provided with a positioning portion 52, and two through holes 520 are formed in the positioning portion 52 for insertion of the two bolts 51 through the cutter seat 10, so that the pressing member 50 is fixed to the cutter seat 10. The pressing member 50 includes a restricting top portion 53 located on the top of the positioning portion 52 and horizontally extending toward the movable tongue seat 20 to restrict the movable tongue 30 within the movable tongue seat 20. Both ends of the restricting top portion 53 are bent toward the movable tongue 30 to form a pressing end 531 to elastically press the movable tongue 30 into the movable tongue seat 20, which prevents disengagement of the movable tongue 30 from the movable tongue seat 20. An elastic portion 54 horizontally extends from the positioning portion 52 and elastically presses against the damping portion 43 of the positioning member 40 to provide a damping effect.

Figure 5:
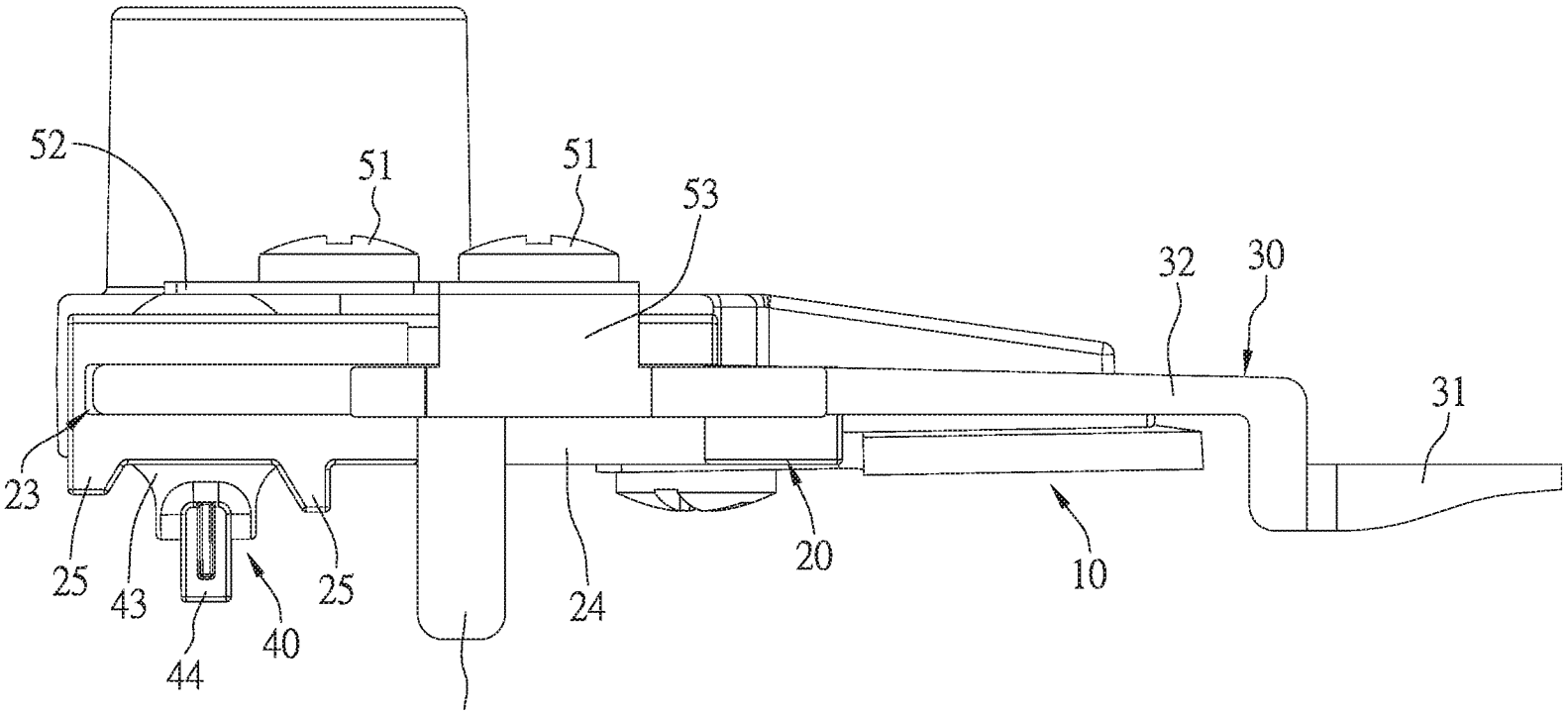
FIG. 5 is a top plan view of the present invention showing that the movable tongue is in its retracted position.
Figure 6:
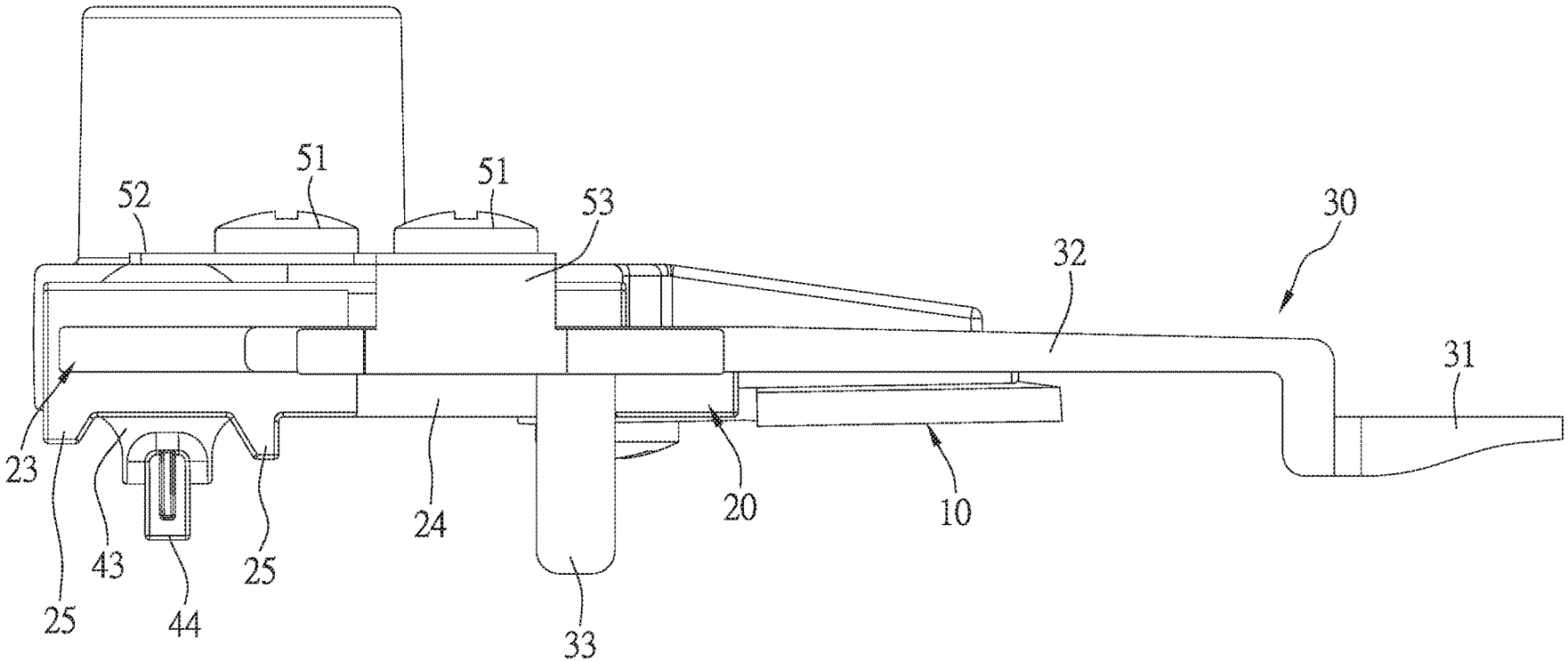
FIG. 6 is a top plan view of the present invention showing that the movable tongue is in its extended position.
Figure 7:
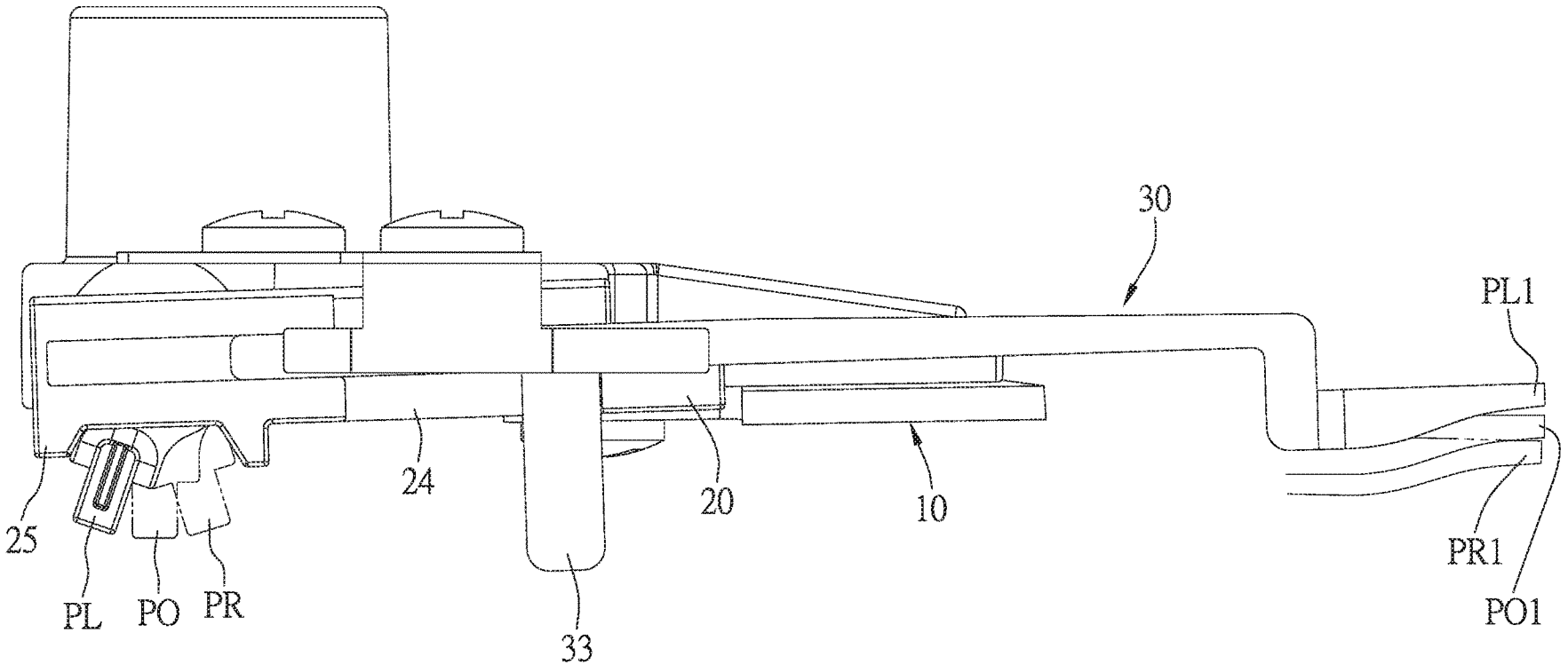
FIG. 7 is a top plan view of the present invention showing that the pulling end is in its retracted position.
Figure 8:
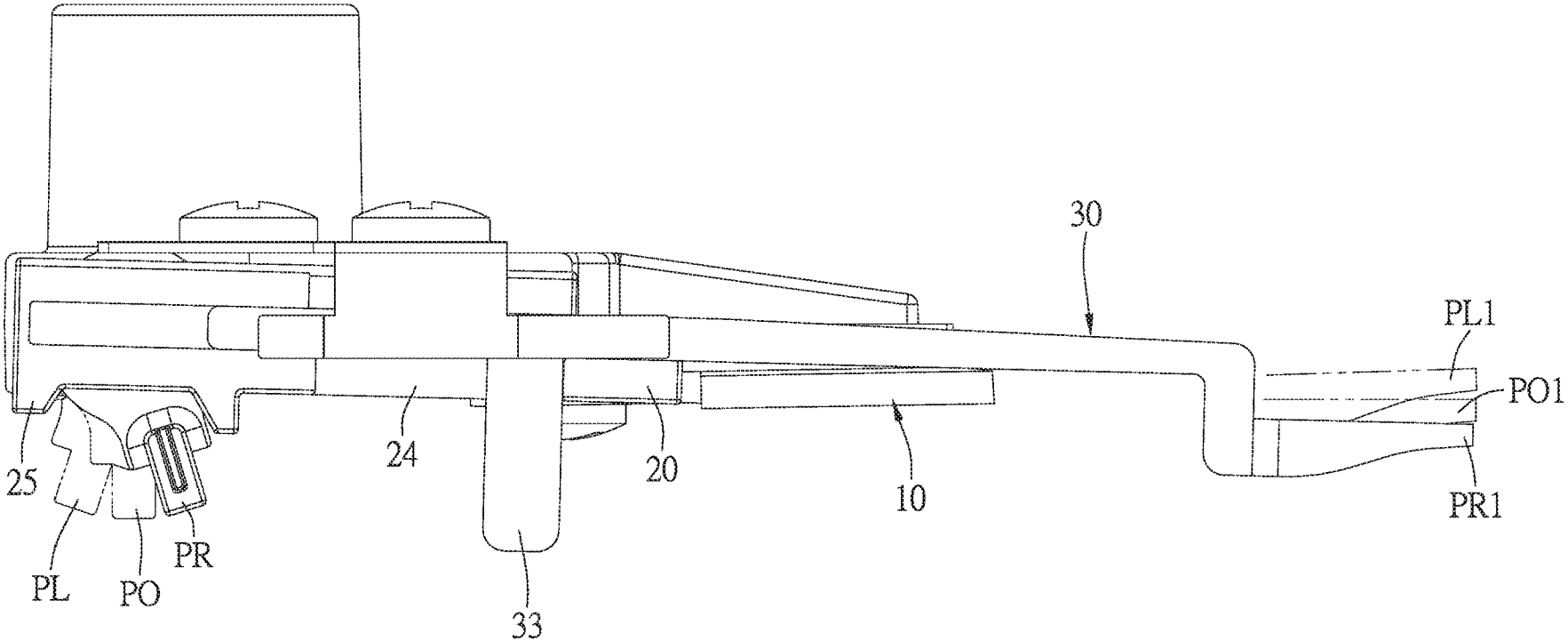
FIG. 8 is a top plan view of the present invention showing that the pulling end is in its extended position.

The operation of the movable tongue 30 is shown in FIGS. 5 and 6, pushing the pulling end 33 of the movable tongue 30 from an end point toward the start point of the gap 24 can push the movable tongue 30 into an extended position as shown in FIG. 6, and pushing it in a reverse direction can switch the movable tongue 30 to a retracted position as shown in FIG. 5. The operation of the present invention is shown in FIGS. 7 and 8, when in the extended position of the movable tongue 30, the positional deviation of the tongue end 31 occurs, as shown in FIGS. 6 and 7, the pulling portion 44 of the positioning member 40 is located in a center position between the two protrusive restricting portions 25, and this position is defined as an original point PO, the position of the left one of the two protrusive restricting portions 25 is defined as a left point PL, and the position of the right one of the two protrusive restricting portions 25 is defined as a right point PR. The corresponding positions of the tongue end 31 to the positions PO, PL and PR of the pulling portion 44 are an original point PO1, a left point PL1 and a right point PR1. As shown in FIG. 8, when the user pulls the pulling portion 44 towards the right point PR, the drive member 42 rotates and pushes the lateral edge of the driven portion 22 to drive the movable tongue seat 20 to rotate around the pivot 21, and as a result, the tongue end 31 of the movable tongue 30 is moved to the right point PR1. As shown in FIG. 7, when the pulling portion 44 is pulled by the user toward the left point PL, and the tongue end 31 of the movable tongue 30 will move to the left point PL1.

Therefore, the position and direction of the tongue end 31 can be intuitively and easily adjusted by pulling the pulling portion 44.

The structure of the present invention offers the following advantages:

1. simple structure: the deviation of the movable tongue seat 20 can be controlled simply by arranging the positioning member 40 between the movable tongue seat 20 and the cutter seat 10, and employing the drive member 42 of the positioning member 40 to contact the driven portion 22 to generate friction force, which requires no further extra structures, and therefore allows for easy assembly and low maintenance.

2. Further, the drive member 42 is a columnar structure and has a plurality of teeth 421 on an outer surface thereof. Therefore, more specifically, the drive member 42 can be a gear, and the driven portion 22 is a rack with a plurality of teeth 221 for engaging with the teeth 421 of the drive member, so that when the drive member 42 rotates, the teeth 421 of the drive member 42 mesh with the corresponding teeth 221 to provide kinetic energy to cause shifting of the movable tongue holder 20.

Figure 9:
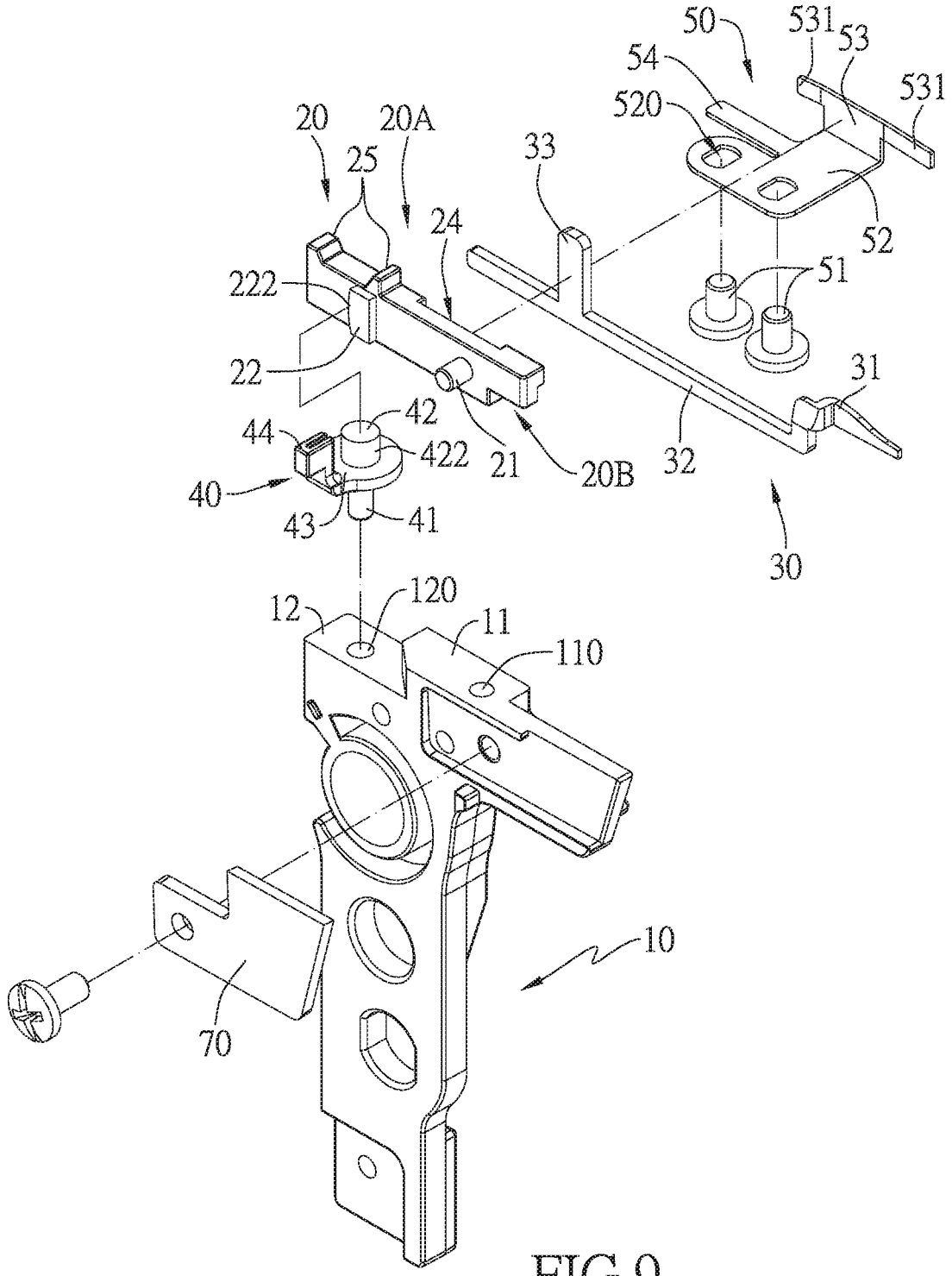
FIG. 9 is an exploded view of the positioning structure for the eccentrically movable tongue seat in accordance with a second embodiment of the present invention.

In the second embodiment of the present invention, as shown in FIG. 9, the drive member 42 has a circumferential surface 422 abutted and pressed against a friction surface 222 of the driven portion 22. The circumferential surface 422 or the friction surface 222 is made of a material capable of generating friction, such as rubber, so that when the drive member 42 rotates, the circumferential surface 422 of the drive member 42 is pressed against the friction surface 222 to provide kinetic energy to cause shifting of the movable tongue seat 20.

Preferably, the drive member 42 is a cylinder, and the circumferential surface 422 is a peripheral surface of the cylinder, and the friction surface 211 has an arc shape.

Preferably, the movable tongue seat 20 has a first side 20A and a second side 20B opposite to each other, and the protrusive restricting portions 25 and the gap 24 are located on the first side 20A. A direction extending between the first side 20A and the second side 20B is a pivoting direction, and the friction surface 211 has a component extending along the pivoting direction great enough to pivot the movable tongue seat 20.

While we have shown and described various embodiments in accordance with the present invention, it is clear to those skilled in the art that further embodiments may be made without departing from the scope of the present invention.

What is claimed is:

1. A positioning device for rotating a movable tongue seat, wherein the tongue seat is provided on a cutter seat of a sewing machine, and a movable tongue is on the movable tongue seat; the positioning device of the movable tongue seat comprising:

a positioning member disposed between the movable tongue seat and the cutter seat, the positioning member being provided with a rotary end which is located toward one end of the cutter seat, wherein the positioning member rotates about the rotary end and is further provided with a drive member having a plurality of teeth for engaging with teeth of a driven portion of the movable tongue seat, so that the drive member drives the driven portion, the drive member and the rotary end are coaxially arranged; and a pivot hole and a pivot provided between the movable tongue seat and the cutter seat, so that the movable tongue seat is able to rotate on the cutter seat by rotating about the pivot, when the positioning member rotates about the rotary end, the drive member pushes the movable tongue seat to rotate about the pivot to a desired position.

2. The positioning device as claimed in claim 1, wherein a top surface of the cutter seat includes a first end surface and a second end surface which is lower than the first end surface, the pivot hole is located at the first end surface for insertion of the pivot which protrudes out of a bottom of the movable tongue seat, and a blade is provided at a lateral surface of the first end surface of the cutter seat.

3. The positioning device as claimed in claim 1, wherein a pressing member is fixed to the cutter seat and includes a restricting top portion extending toward the movable tongue seat to restrict the movable tongue within the movable tongue seat, and an elastic portion horizontally extends from the pressing member and elastically presses against the positioning member to provide a damping effect.

4. The positioning device as claimed in claim 3, wherein the positioning member is further provided with a damping portion which is located between the drive member and the rotary end, the rotary end is located at a center of the damping portion, the elastic portion elastically presses against the damping portion to provide a damping effect, and a pulling portion extends from an edge of the damping portion.

5. The positioning device as claimed in claim 1, wherein the movable tongue which includes a tongue end, a guide portion extending from the tongue end, and a pulling end perpendicular to the guide portion, the movable tongue seat includes a guide member in the form of a groove, and a gap formed in a lateral surface of the guide member, so that the guide portion is slidably received in the guide member, the pulling end extends out of the gap, and a lateral edge of the movable tongue seat cooperates with the pulling portion to restrict a rotation angle of the positioning member.

6. The positioning device as claimed in claim 2, wherein the rotary end is disposed at the second end surface of the cutter seat.

7. A positioning device for rotating a movable tongue seat, wherein the tongue seat is provided on a cutter seat of a sewing machine, and a movable tongue is on the movable tongue seat; the positioning device of the movable tongue seat comprising:

a positioning member disposed between the movable tongue seat and the cutter seat, the positioning member being provided with a rotary end which is located toward one end of the cutter seat, wherein the positioning member rotates about the rotary end and is further provided with a drive member which is in contact with a driven portion of the movable tongue seat to generate friction force to drive the driven portion, the drive member and the rotary end are coaxially arranged; and a pivot hole and a pivot provided between the movable tongue seat and the cutter seat, so that the movable tongue seat is able to rotate on the cutter seat by rotating about the pivot, when the positioning member rotates about the rotary end, the drive member pushes the movable tongue seat to rotate about the pivot to a desired position.

8. The positioning device as claimed in claim 7, wherein the drive member has a circumferential surface abutted and pressed against a friction surface of the driven portion.

9. The positioning device as claimed in claim 7, wherein a top surface of the cutter seat includes a first end surface and a second end surface which is lower than the first end surface, the pivot hole is located at the first end surface for insertion of the pivot which protrudes out of a bottom of the movable tongue seat, and a blade is provided at a lateral surface of the first end surface of the cutter seat.

10. The positioning device as claimed in claim 8, wherein a top surface of the cutter seat includes a first end surface and a second end surface which is lower than the first end surface, the pivot hole is located at the first end surface for insertion of the pivot which protrudes out of a bottom of the movable tongue seat, and a blade is provided at a lateral surface of the first end surface of the cutter seat.

11. The positioning device as claimed in claim 7, wherein a pressing member is fixed to the cutter seat and includes a restricting top portion extending toward the movable tongue seat to restrict the movable tongue within the movable tongue seat, and an elastic portion horizontally extends from the pressing member and elastically presses against the positioning member to provide a damping effect.

12. The positioning device as claimed in claim 8, wherein a pressing member is fixed to the cutter seat and includes a restricting top portion extending toward the movable tongue seat to restrict the movable tongue within the movable tongue seat, and an elastic portion horizontally extends from the pressing member and elastically presses against the positioning member to provide a damping effect.

13. The positioning device as claimed in claim 11, wherein the positioning member is further provided with a damping portion which is located between the drive member and the rotary end, the rotary end is located at a center of the damping portion, the elastic portion elastically presses against the damping portion to provide a damping effect, and a pulling portion extends from an edge of the damping portion.

14. The positioning device as claimed in claim 12, wherein the positioning member is further provided with a damping portion which is located between the drive member and the rotary end, the rotary end is located at a center of the damping portion, the elastic portion elastically presses against the damping portion to provide a damping effect, and a pulling portion extends from an edge of the damping portion.

15. The positioning device as claimed in claim 13, wherein the movable tongue which includes a tongue end, a guide portion extending from the tongue end, and a pulling end perpendicular to the guide portion, the movable tongue seat includes a guide member in the form of a groove, and a gap formed in a lateral surface of the guide member, so that the guide portion is slidably received in the guide member, the pulling end extends out of the gap, and a lateral edge of the movable tongue seat cooperates with the pulling portion to restrict a rotation angle of the positioning member.

16. The positioning device as claimed in claim 14, wherein the movable tongue which includes a tongue end, a guide portion extending from the tongue end, and a pulling end perpendicular to the guide portion, the movable tongue seat includes a guide member in the form of a groove, and a gap formed in a lateral surface of the guide member, so that the guide portion is slidably received in the guide member, the pulling end extends out of the gap, and a lateral edge of the movable tongue seat cooperates with the pulling portion to restrict a rotation angle of the positioning member.

17. The positioning device as claimed in claim 9, wherein the rotary end is disposed at the second end surface of the cutter seat.

18. The positioning device as claimed in claim 10, wherein the rotary end is disposed at the second end surface of the cutter seat.

* * * * *